United States Patent [19]

Youree et al.

[11] Patent Number: 4,725,796

[45] Date of Patent: Feb. 16, 1988

[54] MILLIMETER AND INFRA-RED WAVELENGTH SEPARATING DEVICE

[75] Inventors: Roger K. Youree, Madison; Vernon W. Ramsey, Huntsville, both of Ala.

[73] Assignee: The Boeing Company, Seattle, Wash.

[21] Appl. No.: 910,826

[22] Filed: Sep. 23, 1986

Related U.S. Application Data

[63] Continuation of Ser. No. 711,264, Mar. 13, 1985, abandoned.

[51] Int. Cl.[4] ..... H01P 1/213

[52] U.S. Cl. ..... 333/135; 343/776

[58] Field of Search ..... 333/134–137, 333/126, 129; 343/772, 773, 776

[56] References Cited

U.S. PATENT DOCUMENTS

| | | | |
|---|---|---|---|
| 2,434,646 | 1/1948 | Fox | 333/135 |
| 2,526,573 | 10/1950 | Mason | 333/135 |
| 2,938,177 | 5/1960 | Vogelman | 333/126 |
| 2,963,661 | 12/1960 | Seidel | 333/110 |
| 2,972,743 | 2/1961 | Svensson et al. | 343/838 |
| 2,975,380 | 3/1961 | Scharfman | 333/248 X |
| 3,058,072 | 10/1962 | Rizzi et al. | 333/208 |
| 3,785,717 | 1/1974 | Croset et al. | 333/113 X |
| 3,918,010 | 4/1973 | Marchalot | 333/113 |
| 4,052,724 | 10/1977 | Takeichi et al. | 343/786 |
| 4,319,206 | 3/1982 | Schuegraf | 333/126 |
| 4,458,217 | 7/1984 | Wong et al. | 333/135 |
| 4,477,814 | 10/1984 | Brumbaugh et al. | 343/725 |
| 4,516,089 | 5/1985 | Gosciansk et al. | 343/772 X |

*Primary Examiner*—Eugene R. LaRoche
*Assistant Examiner*—Benny T. Lee
*Attorney, Agent, or Firm*—Finnegan, Henderson, Farabow, Garrett & Dunner

[57] ABSTRACT

A wavelength separator for separating various electromagnetic signals in such a manner that the separated signals are not seriously attenuated or altered. Ideally, the separator functions best when the ratio of long-wavelength and short-wavelength is greater than 100.

11 Claims, 4 Drawing Figures

MILLIMETER AND INFRA-RED WAVELENGTH SEPARATING DEVICE

This application is a continuation of application Ser. No. 711,264 filed Mar. 13, 1985, now abandoned.

BACKGROUND OF THE INVENTION

This invention relates to a wavelength separator and more particularly, but not by way of limitation, for separating long-wavelength and short-wavelength electromagnetic signals.

Heretofore, there have been various attempts to separate electromagnetic signals having different wavelengths by splitting the combined signals into two or more wave guides and then filtering out all the signals not of a desired wavelength. This method of wavelength separation has a disadvantage of severely lowering the signal strength.

Also, other wavelength separation methods have utilized screens and other types of filters to reflect some of the wavelength and allow others to pass. Determining the appropriate filtering material is often a problem and the signal attenuation for this type of method is frequently prohibitive.

In the following U.S. Pat. No. 2,434,646 to Fox, U.S. Pat. No. 2,526,573 to Mason, U.S. Pat. No. 2,938,177 to Vogelman, U.S. Pat. No. 2,963,661 to Seidel, U.S. Pat. No. 2,972,743 to Svensson et al, U.S. Pat. No. 3,058,072 to Rizzi et al, U.S. Pat. No. 4,052,724 to Takeichi et al, U.S. Pat. No. 4,319,206 to Schuegraf, U.S. Pat. No. 4,458,217 to Wong et al and U.S. Pat. No. 4,477,814 to Brumbaugh et al, various types of wavelength separators are disclosed. None of them provide the unique features and advantages of the subject wavelength separator as described herein. In particular, the invention described herein differs from the prior art referenced above in that is does not use wave guide irises, bandpass filters, and recombinations hybrids to achieve the signal separation. Such devices greatly increase signal loss, and reduce the efficiency of the separation process. In addition, the prior art devices separate the input composite signal into very narrow frequency bands. The invention described herein provides the required separation over the full waveguide bandwidth of the entrance waveguide.

SUMMARY OF THE INVENTION

The subject wavelength separator solves the problem of separating a mixture of electromagnetic signals of various wavelengths in such a manner that signals are not seriously attenuated or altered.

The subject separator is a passive device and uses common material with simple construction techniques and a minimum of design effort. The separator can separate two or more signals of different wavelengths entering a guide housing having guide channels with sufficient dimensions to allow propagation of the signals.

The separator includes a wave guide housing having a signal entrance for receiving the signals therethrough. A large guide channel is connected to the signal entrance and has a sufficient dimension to allow propagation of the signals. The large guide channel is curved in the housing and connected to a signal exit in the housing. A small guide channel is connected to the large guide channel downstream from the signal entrance. The axis of the small guide channel is coaxial with the initial direction of the large guide channel. The small guide channel has a smaller dimension than the large guide channel. Additional guide channels may be added for separating signals of intermediate wavelengths.

The advantages and objectives of the invention will become evident from the following detailed description of the drawings when read in connection with the accompanying drawings which illustrate preferred embodiments of the invention.

DETAILED DESCRIPTION OF THE DRAWINGS

Figure 1:
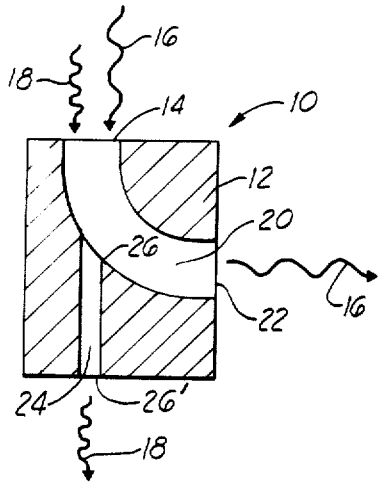
FIG. 1 is a cross-sectional view of the separation region in the device.

In FIG. 1 the wavelength separator for separating various signals is designed by general reference numeral 10. The separator 10 includes a wave guide housing 12 with a signal entrance 14 therein for receiving an electromagnetic signal having a long-wavelength signal indicated by arrow 16 and a short-wavelength signal indicated by arrow 18. Communicating with the signal entrance 14 is a large guide channel 20 having a sufficient dimension to allow propagation of the signals 16 and 18 therein. The large guide channel 20 is curved in the housing 12 and connects to a first signal exit 22.

A small guide channel 24 is connected to the large guide channel 20 at a junction point 26 downstream from the signal entrance 14. The axis of the small guide channel 24 is coaxial with the initial direction of the large guide channel 20. The small guide channel 24 includes a second signal exit 26. The small guide channel 24 has a smaller dimension than the large guide channel 20. The smaller guide channel 24 has a cut-off frequency above the frequency of the long-wave signal 16, but allows the frequency of the short-wave signal 18 therethrough. Because of the large frequency separation between the two channels the long-wavelength signals 16 will not propagate into the smaller wave guide channel 24, but will instead follow the curve or bend of the large guide channel 20. Long-wavelength fields in the small wave guide are evanescent modes which essentially die out before reaching exit 26. The short-wave signal 18 will propagate optically into the smaller wave channel 24 and because of the line-of-sight nature of this optical propagation, will not diffract into the bend or curve of the large wave guide channel 20. The short wavelength signal 18 is thus operating in an optical realm where the cross-sectional dimensions of the small wave guide channel are very large in wavelengths.

Figure 2:
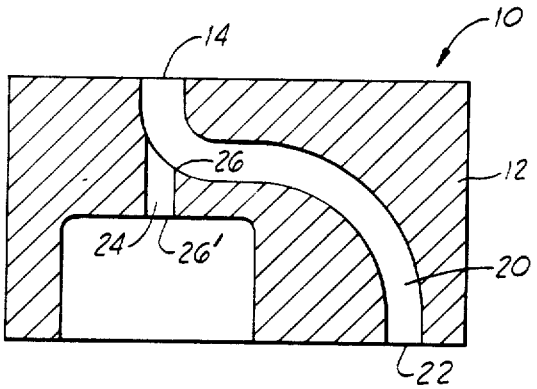
FIG. 2 is a cross-sectional view of the separator.

In FIG. 2 the wavelength separator 10 having a wave guide housing 12 is shown in an embodiment for separating infrared signals and millimeter wave signals. The large wave guide channel 20 which meets smaller wave guide channel 24 at junction point 26, in this illustration has a rectangular shape with the smaller wave guide channel 24 dimensioned in the range of 0.05 inches in diameter with a cylindrical wave guide construction. The average length of the smaller guide channel 24 is 0.10 inches. When the millimeter wave signals are launched into the signal entrance 14 of the housing 12 it was found that approximately 83% of the incident power exited through the signal exit 22. Of the 17% loss incurred, 3% was due to the presence of the small wave guide channel 24 and 3% of the signal was lost due to reflections out of the signal entrance 14. Of the infrared power incident on the signal entrance, 69% was transmitted through the smaller guide channel 24.

In summary, millimeter wave signal loss through the separator 10 was a total of 17% with a loss of 3% due to the small guide channel 24. Millimeter wave signal reflection amounted to 3% with infrared loss through the separator 10 to be a total of 31%.

Figure 3:
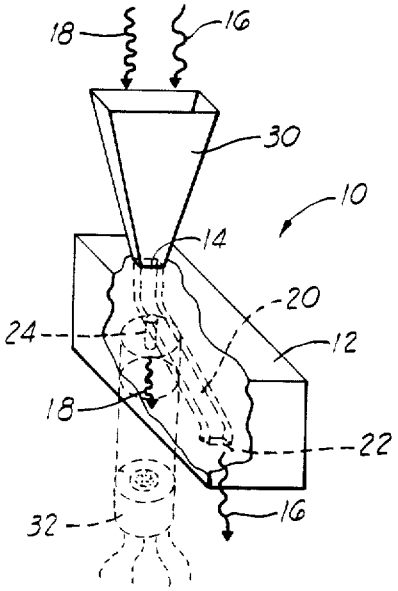
FIG. 3 is a perspective view of the separator with a feedhorn and infrared detector assembly.

In FIG. 3 the wave guide separator 10 is shown with a feedhorn 30 used for receiving the infrared wave signals 18 and millimeter signals 16. In this figure the large guide channel 20 is shown in a rectangular configuration with the smaller wave guide channel in a cylindrical configuration and communicating with an infrared detector module 32.

Figure 4:
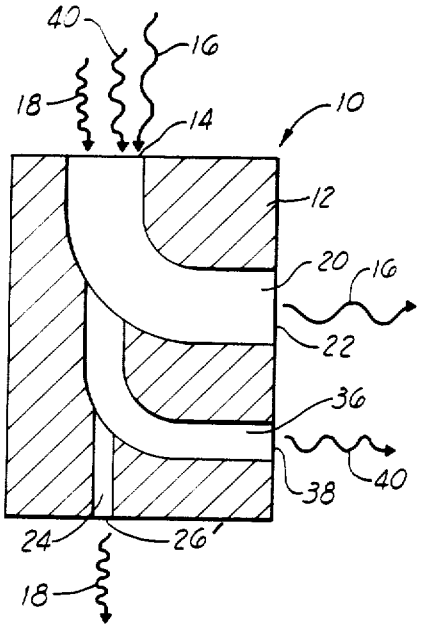
FIG. 4 illustrates an alternate embodiment for separating three wavelengths.

In FIG. 4 an alternate embodiment of the separator 10 is illustrated for providing a means for cascading additional wave guide separation channels. In this configuration an intermediate wave guide channel 36 is provided which communicates downstream from the signal entrance 14 of the large guide channel 20. The small wave guide channel 24, which exists at 26' in turn communicates with the intermediate guide channel 36 at junction 37 with the axis of the small guide channel remaining axially aligned with the initial direction of the large guide channel 20 and the intermediate guide channel 36. The intermediate guide channel includes a third signal exit 38. In this example the separator 10 gives not only the signal 16 and 18 but an intermediate wavelength signal indicated by arrow 40.

It should be noted that the wavelength separator 10 further lends itself for different transmission mediums. For example, the small guide channel 24 may be constructed using fiber optics material with the large guide channel 20 remaining as an air filled wave guide. Likewise the addition of lenses to focus the short-wavelength radiation does not alter the basic concept as described herein.

Changes may be made in the construction and arrangement of the parts or elements of the embodiments as described herein without departing from the spirit or scope of the invention defined in the following claims.

What is claimed is:

1. A wavelength separator for separating various wavelengths of a signal, the separator comprising:

a wave guide housing having a top surface, bottom surface and side surfaces, the top surface of the housing having a signal entrance for receiving signals therein;

a large guide channel located in the housing and connected to the signal entrance, the channel having a sufficient dimension to allow propagation of the signal, the large guide channel extending downwardly from top to bottom and curved in the housing toward one of the sides and connected at another end to a first signal exit in one side surface of the housing;

an intermediate guide channel connected at an end to the large guide channel, the intermediate guide channel extending downwardly from top to bottom and curved in the housing toward one of the sides and connected at another end to a third signal exit in the side surface of the housing and a small guide channel connected at an end to the intermediate guide channel, the small guide channel having a smaller dimension than the intermediate guide channel, the small guide channel having an axis axially aligned with the initial direction of the large and intermediate guide channels and the small guide channel including a second signal exit at the bottom surface of the housing.

2. The separator as described in claim 1 wherein the large guide channel is rectangular in cross-section.

3. The separator as described in claim 1 wherein the small guide channel is cylindrical in shape.

4. The separator as described in claim 1 further including a feedhorn communicably connected to the signal entrance of the wave guide housing for introducing the signals therein.

5. A wavelength separator comprising:

a wave guide housing having top, bottom, and side exterior surfaces, the top surface of the housing having a signal entrance for receiving signals therein;

a large guide channel located in the housing and connected to the signal entrance, said large guide channel being operative to receive a selected long-wavelength signal and a shorter wavelength signal, the channel having a cross-sectional area sufficient to allow propagation of the selected long-wavelength signal, the large guide channel extending in a direction downwardly from top to bottom for a first portion of the large guide channel and curved in the housing toward one of the side surfaces for a second portion of the large guide channel and connected to a first signal exit in one of said surfaces of the housing;

a small guide channel communicating with the large guide channel and extending downward from adjacent the first and second portions of the large guide channel, with an axis in alignment with said first portion of the large guide channel, to a second signal exit at the bottom surface of the housing, the small guide channel having a cross-sectional area, for passing a selected signal shorter in wavelength than the propagated wavelength in the large guide channel, less than the cross-sectional area of the large guide channel, said small guide channel cross-sectional area being sufficient to block effectively the entrance of the wavelength signal propagated by the large guide channel through said second portion.

6. A wavelength separator according to claim 5 further comprising:

an intermediate guide channel communicating at one end with the large guide channel and communicating at a distance from said one end with the small guide channel and having a cross-sectional area smaller than the large wave guide channel and larger than the small guide channel for passing the shorter wavelength signal and propagating a signal having a wavelength blocked by the small guide channel, said intermediate guide channel curving at an angle relative to the axis of the small guide channel and communicating at an opposite end with a third signal exit in the housing.

7. A wavelength separator according to claim 5 wherein the large guide channel is substantially rectangular in cross-section.

8. A wavelength separator according to claim 5 wherein the small guide channel is circular in cross-section.

9. A wavelength separator according to claim 5 wherein the long-wavelength signal is in the microwave to millimeter realm and the shorter wavelength signal is in the optical realm.

10. A device for channeling a first wavelength signal and a second wavelength signal into separate paths wherein said second wavelength signal has a shorter wavelength than said first wavelength signal and is in the optical realm, said device comprising:

a housing having top, bottom and side exterior surfaces, said top surface having a signal entrance for receiving said signals;

a guide channel located in the housing and communicating with the signal entrance, said channel having a first portion extending linearly downwardly from the top surface and a second portion curved in the housing, said second portion communicating with a first signal exit in one of said exterior surfaces;

said guide channel having an opening in the first portion adjacent the second portion for connecting the first portion of the guide channel to a second signal exit in the bottom surface of the housing, said opening being axially aligned with the signal entrance in the top surface and the second signal exit in the bottom surface for passing the second wavelength signal in the optical realm through the second signal exit, said opening having a cross-sectional dimension sufficient to block the reception of the first wavelength signal for permitting propagation of the first wavelength signal through the second portion of the guide channel.

11. A device according to claim 10 wherein the opening in the guide channel and the signal exit are circular in cross-section with a cylindrical channel therebetween, and wherein both the first and second portions of the guide channel are substantially rectangular in cross-section.

* * * * *

UNITED STATES PATENT AND TRADEMARK OFFICE

CERTIFICATE OF CORRECTION

PATENT NO. : 4,725,796

DATED : FEBRUARY 16, 1988

INVENTOR(S) : ROGER K. YOUREE and VERNON K. RAMSEY

It is certified that error appears in the above-identified patent and that said Letters Patent is hereby corrected as shown below:

Column 2, line 23, "designed" should be --designated--.

Signed and Sealed this

Fifth Day of July, 1988

*Attest:*

DONALD J. QUIGG

*Attesting Officer*

*Commissioner of Patents and Trademarks*